US009410765B2

(12) United States Patent
Bednar et al.

(10) Patent No.: US 9,410,765 B2
(45) Date of Patent: Aug. 9, 2016

(54) CROSSBOW INTEGRATED GRIP GUARD

(71) Applicants: Hunter's Manufacturing Company, Inc., Sufffield, OH (US); Richard L. Bednar

(72) Inventors: Richard L. Bednar, Munroe Falls, OH (US); Michael J. Shaffer, Mogadore, OH (US); Jacob A. Hout, Akron, OH (US); William J. Bednar, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 14/173,319

(22) Filed: Feb. 5, 2014

(65) Prior Publication Data

US 2015/0219420 A1 Aug. 6, 2015

(51) Int. Cl.

| | |
|---|---|
| ***F41B 5/12*** | (2006.01) |
| ***F41C 23/16*** | (2006.01) |
| ***F41B 5/14*** | (2006.01) |

(52) U.S. Cl.

CPC . *F41C 23/16* (2013.01); *F41B 5/12* (2013.01); *F41B 5/1426* (2013.01); *F41B 5/1469* (2013.01)

(58) Field of Classification Search

CPC ..... F41B 5/12; F41B 5/148; F41C 23/16
USPC ..... 124/25
See application file for complete search history.

(56) References Cited

U.S. PATENT DOCUMENTS

| | | | | |
|---|---|---|---|---|
| 6,988,495 | B1 * | 1/2006 | Van Hoorn | F41B 5/14 124/88 |
| 7,455,059 | B2 | 11/2008 | Shaffer | |
| 7,661,418 | B2 | 2/2010 | Bednar et al. | |
| 8,061,339 | B2 | 11/2011 | Shaffer | |
| 8,127,752 | B2 | 3/2012 | Bednar et al. | |
| 8,220,445 | B2 * | 7/2012 | Bednar | F41B 5/123 124/25 |
| 2012/0006311 | A1 | 1/2012 | Bednar et al. | |
| 2012/0266514 | A1 * | 10/2012 | Michal | F41C 23/16 42/90 |

* cited by examiner

*Primary Examiner* — Gene Kim
*Assistant Examiner* — Jeffrey Vanderveen
(74) *Attorney, Agent, or Firm* — Emerson Thomson Bennett

(57) ABSTRACT

A grip guard may be used with a crossbow that has a main beam including a stock and a barrel. The grip guard may have a first wall that is positioned between the stock and the barrel and a second wall that extends outwardly from the main beam. The first wall may have dampening properties to attenuate sounds and vibrations caused by firing the crossbow and the second wall may prevent a user's fingers from inadvertently extending from the handle toward the barrel.

15 Claims, 16 Drawing Sheets

CROSSBOW INTEGRATED GRIP GUARD

I. BACKGROUND

A. Field of the Invention

This invention generally relates to methods and apparatuses related to crossbows and more specifically to methods and apparatuses related to dampening the vibrations between a crossbow's stock and barrel.

B. Description of Related Art

Crossbows have been used for many years as a weapon for hunting, fishing, and for target shooting. Significant development of the crossbow has occurred to increase the force with which an arrow is shot, increase shooting accuracy, and to make the crossbow safer. In general, a crossbow includes a bow assembly and a trigger mechanism both mounted to a main beam. The main beam generally includes a stock, which the user holds when carrying and shooting the crossbow, and a barrel that is supported to the stock. A trigger mechanism, also supported to the main beam, holds the bowstring of the bow assembly in a drawn or cocked condition and can thereafter be operated to release the bowstring out of the uncocked condition to shoot or fire the arrow.

One problem with crossbows is that while firing them some users have inadvertently placed a thumb or finger on or near the barrel in the path of the moving bowstring, causing injury. To reduce this problem, it is known to provide crossbows with grip guards that extend outwardly from the stock and thus prevent users from inadvertently placing a thumb or finger into a dangerous position on or near the barrel. It is known to attach such grip guards as separate pieces to the stock. It is also known to form grip guards as one piece with the stock, such as by molding the grip guard with the stock. An example of a crossbow grip guard is provided in Pub. No.: US 2007/0028907.

Another problem with crossbows, especially given the larger forces they generate, is the corresponding large vibrations. These vibrations result in unwanted noise that is both too loud (as measured in decibels) and too long in duration. While some elements of the vibration problem have been addressed, such as vibration dampening arrow retention springs provided in U.S. Pat. Nos. 8,061,339 and 7,455,059 and barrel cable suppressors, provided in Pub. No.: US 20012/0006311, additional improvement is desirable. One aspect of vibrations currently under addressed is the vibration that occurs between the barrel and the stock. Often the barrel is made of metal, typically aluminum or aluminum alloy, while the stock is made of another material.

What is needed, is a grip guard that both prevents inadvertent contact of the user's fingers with the barrel and reduces vibration between the barrel and the stock.

II. SUMMARY

According to one embodiment of this invention, a crossbow, may comprise: (A) a main beam having first and second sides and comprising: (1) a stock that comprises a handle that is suitable to be gripped by an associated user to hold the crossbow when firing the crossbow; (2) a barrel that: (a) is suitable to support an associated projectile for firing by the crossbow; and, (b) is supported to the stock; (B) first and second limbs that: (1) are supported to the main beam; and, (2) extend outwardly from proximal ends to distal ends on opposite sides of the main beam; (C) a bowstring that: (1) is strung between the distal ends of the first and second limbs; and, (2) is adjustable from an uncocked position to a cocked position; (D) a trigger mechanism that: (1) is supported to the main beam; (2) is operable to hold the bowstring in the cocked position; and, (3) is operable to release the bowstring to fire the associated projectile; (E) a first grip guard comprising: (1) a first wall that: (a) is positioned between the stock and the barrel on the first side of the main beam; (b) has a first side that contacts the stock on the first side of the main beam; and, (c) has a second side that contacts the barrel on the first side of the main beam; and, (2) a second wall that: (a) extends outwardly from the first side of the main beam; (b) is positioned at least partially between the handle and the barrel on the first side of the main beam; and, (c) when the associated user's hand having fingers is properly holding the handle to tire the crossbow, prevents the fingers from extending beyond the second wall of the first grip guard toward the barrel on the first side of the main beam; and, (F) a second grip guard comprising: (1) a first wall that: (a) is positioned between the stock and the barrel on the second side of the main beam; (b) has a first side that contacts the stock on the second side of the main beam; and, (c) has a second side that contacts the barrel on the second side of the main beam; and, (2) a second wall that: (a) extends outwardly from the second side of the main beam; (b) is positioned at least partially between the handle and the barrel on the second side of the main beam; and, (c) when the associated user's hand is properly holding the handle to fire the crossbow, prevents the fingers from extending beyond the second wall of the second grip guard toward the barrel on the second side of the main beam.

According to another embodiment of this invention, a grip guard may be used with an associated crossbow. The associated crossbow may comprise: (A) a main beam comprising: (1) a stock that comprises a handle that is suitable to be gripped by an associated user to hold the crossbow when firing the crossbow; (2) a barrel that: (a) is suitable to support an associated projectile for firing by the crossbow; and, (b) is supported to the stock; (B) first and second limbs that: (1) are supported to the main beam; and, (2) extend outwardly from proximal ends to distal ends on opposite sides of the main beam; (C) a bowstring that: (1) is strung between the distal ends of the first and second limbs; and, (2) is adjustable from an uncocked position to a cocked position; and, (D) a trigger mechanism that: (1) is supported to the main beam; (2) is operable to hold the bowstring in the cocked position; and, (3) is operable to release the bowstring to fire the associated projectile. The grip guard may comprise: (A) a first wall that: (1) is positioned between the stock and the barrel; (2) has a first side that contacts the stock; and, (3) has a second side that contacts the barrel; and, (B) a second wall that: (1) extends outwardly from the main beam; (2) is positioned at least partially between the handle and the barrel; and, (3) when the associated user's hand having fingers is properly holding the handle to tire the crossbow, prevents the fingers from extending beyond the second wall toward the barrel.

According to yet another embodiment of this invention, a method may include the steps of: I. providing a crossbow, comprising: (A) a main beam comprising: (1) a stock that comprises a handle that is suitable to be gripped by an associated user to hold the crossbow when firing the crossbow; (2) a barrel that: (a) is suitable to support an associated projectile for firing by the crossbow; and, (b) is supported to the stock; (B) first and second limbs that: (1) are supported to the main beam; and, (2) extend outwardly from proximal ends to distal ends on opposite sides of the main beam; (C) a bowstring that: (1) is strung between the distal ends of the first and second limbs; and, (2) is adjustable from an uncocked position to a cocked position; (D) a trigger mechanism that: (1) is supported to the main beam; (2) is operable to hold the bowstring in the cocked position: and, (3) is operable to release the bowstring to fire the associated projectile; II. providing a first grip guard comprising: (1) a first wall; and, (2) a second wall; III. positioning the first wall of the first grip guard between the stock and the barrel so that the second wall of the first grip guard: (a) extends outwardly from the main beam; (b) is positioned at least partially between the handle and the barrel; and, (c) when the associated user's hand having fingers is properly holding the handle to fire the crossbow, prevents the fingers from extending beyond the second wall of the firstgrip guard toward the barrel; and, IV. firing the crossbow, wherein the first wall of the firstgrip guard operates as a dampener that attenuates sounds and vibrations caused by firing the crossbow One advantage of this invention according to some embodiments is that injury caused by inadvertent placement of a user's thumb or finger on or near the barrel can be reduced.

Another advantage of this invention according so some embodiments is that vibrations between the barrel and stock of crossbows can be attenuated.

Yet another advantage of this invention according to some embodiments is that the same component used to reduce injury on a crossbow can also be used to attenuate vibrations.

III. DEFINITIONS

The following definitions are applicable to the present invention:

"Barrel" means the portion of the main beam that is used to support a projectile, such as an arrow, to be shot, fired or propelled by the crossbow. The barrel may include a pathway, such as a groove, track or elongated slot, which is suitable to hold and guide the projectile.

"Bow" means a bent, curved or arched object having a pair of limbs. A bow may be a single piece or may have separate limbs that together form the bow.

"Bow Assembly" means a weapon comprising a bow and a bowstring that shoots, fires or propels projectiles powered by the elasticity of the limbs and/or the drawn bowstring.

"Bowstring" means a string or cable attached to the limbs of a bow.

"Compound Bow" means a crossbow that has wheels, pulleys or cams at each end of the limbs through which the bowstring passes.

"Crossbow" means a weapon comprising a bow assembly and a trigger mechanism both mounted to a main beam.

"Main Beam" means the elongated structural member of a crossbow that is used to support the bow assembly, the trigger mechanism and often other components as well. The main beam often includes a stock and a barrel.

"Pathway" means the portion of the barrel which guides the projectile while the projectile is being loaded in the crossbow or being shot, fired or propelled from the crossbow.

"Stock" means the portion of the main beam which the user holds when carrying and shooting the crossbow. Typically the stock supports the barrel and the trigger mechanism.

"Trigger Mechanism" means any device that holds the bowstring of a crossbow in the drawn or cocked condition and which can thereafter be operated to release the bowstring out of the drawn or cocked condition to shoot, fire or propel the projectile.

"Weapon" means any device that can be used in fighting or hunting that shoots, tires or propels a projectile including bow assemblies and crossbows.

IV. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

V. DETAILED DESCRIPTION

Figure 1:
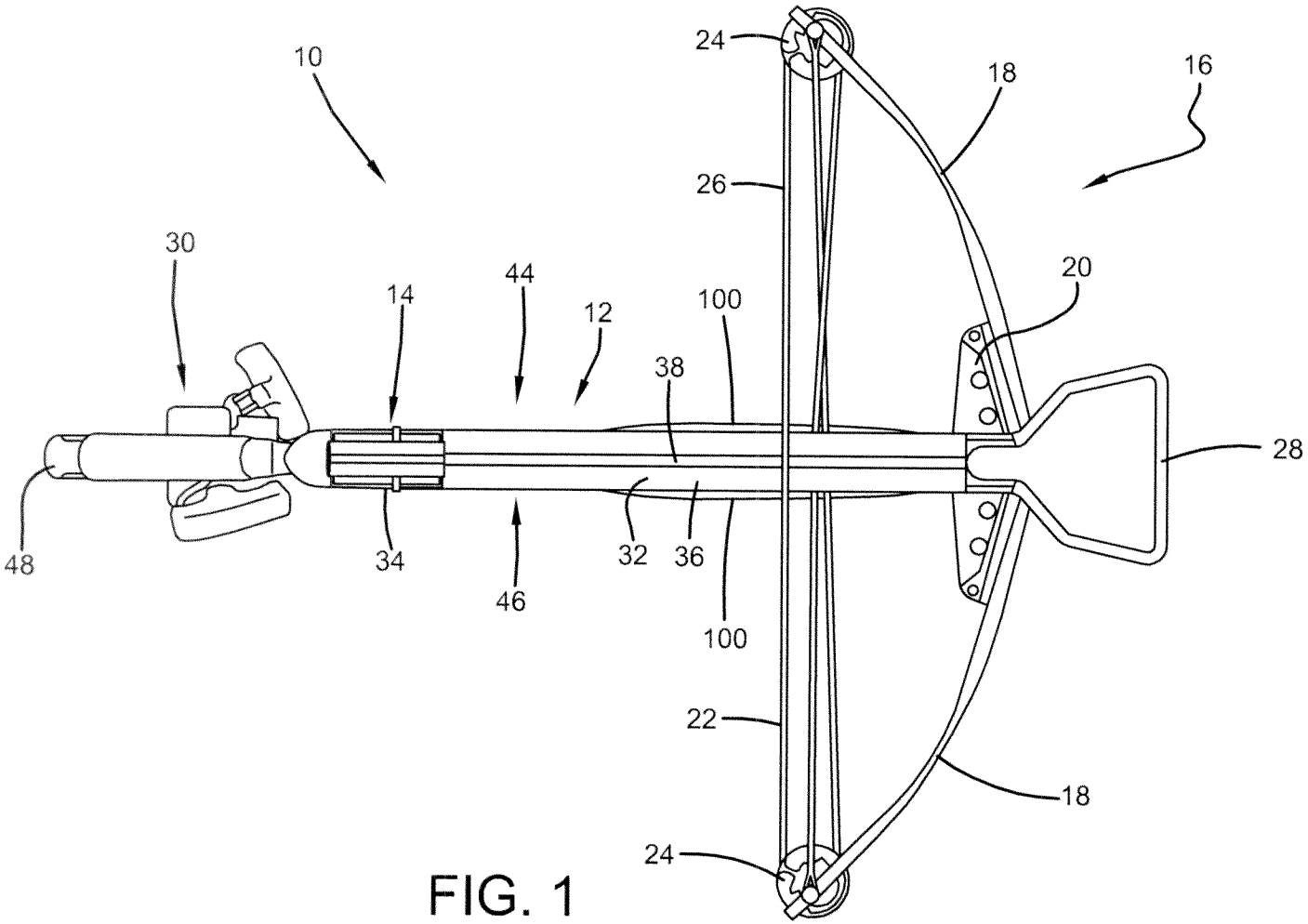
FIG. 1 is a top view of a crossbow.

Referring now to the drawings wherein the showings are for purposes of illustrating embodiments of the invention only and not for purposes of limiting the same, and wherein like reference numerals are understood to refer to like components, FIG. 1 shows a crossbow 10 using a pair of grip guards 100, 100 according to some embodiments of this invention. While the crossbow shown is a compound bow, this invention is not limited to any particular type or size of crossbow as long as it is used with the sound judgment of a person of skill in the art. The crossbow 10 may include a main beam 12 with a trigger mechanism 14 and a bow assembly 16 supported to the main beam 12. The trigger mechanism 14 and bow assembly 16 can be of any type chosen with the sound judgment of a person of skill in the art.

With continuing reference to FIG. 1, the bow assembly 16 may include two outwardly extending limbs 18 that are supported to the main beam 12 and extend outwardly from proximal ends to distal ends on opposite sides, 44, 46 of the main beam 12 from a riser 20 that may be mounted to the distal end of the main beam 12. A bowstring 22 may be strung between the distal ends of the limbs 18. The crossbow 10 may also have a pair of pulley wheels, cams or other known devices 24 affixed to the limbs 18 to carry the bowstring 22 and one or more tension cable(s) 26 in a compound bow arrangement. A stirrup bracket 28 may extend from the distal end of the riser 20. A drawing or cocking mechanism 30 may be supported to the main beam 12 and used to draw or cock the bowstring 22 into a drawn or cocked position. Alternatively, a portable cocking mechanism that is not supported to the crossbow 10 or no cocking mechanism at all (in some cases the user may be able to cock the crossbow manually without the aid of any cocking mechanism) may be used. The trigger mechanism 14 may be operable hold the bowstring 22 in the cocked position and operable to release the bowstring 22 to fire the projectile.

Figure 2:
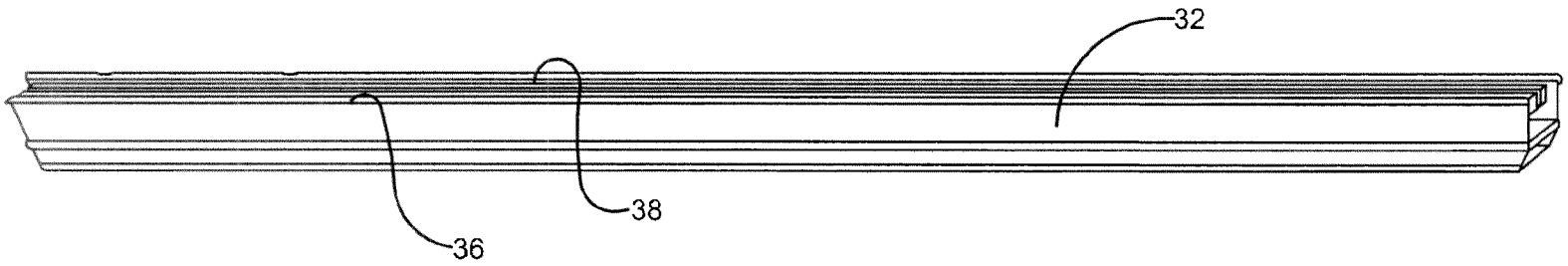
FIG. 2 is a perspective side view of a barrel.
Figure 3:
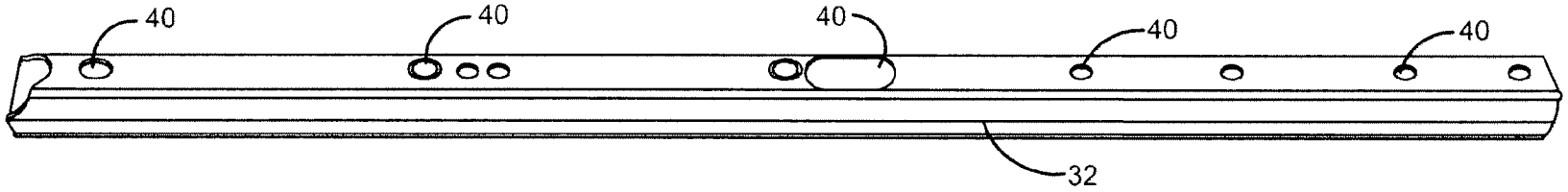
FIG. 3 is a perspective bottom view of the barrel shown in FIG. 2.
Figure 4:
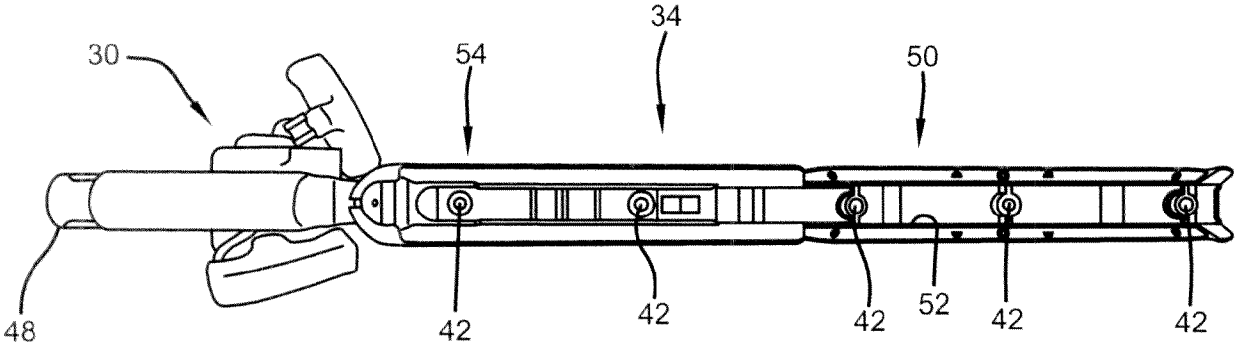
FIG. 4 is a top view of a stock.
Figure 5:
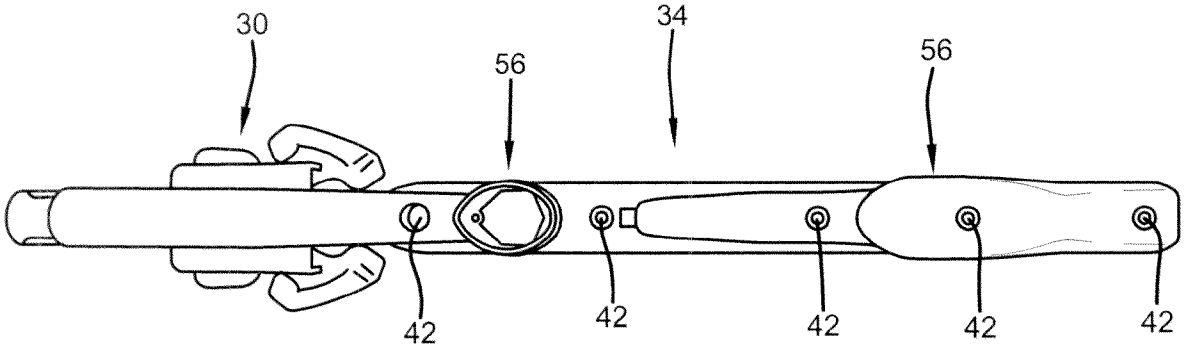
FIG. 5 is a bottom view of the stock shown in FIG. 4.

With continuing reference to FIG. 1, the main beam 12 may include a barrel 32 supported to a stock 34. The barrel 32, also shown in FIGS. 2 and 3, may include an upper surface 36 having a pathway 38 on which an arrow or other projectile (not shown, but well known in the art) is positioned. The bowstring 22 may slide on this upper surface 36 in operation of the crossbow 10. The barrel 32 may have any appropriate number of openings or other surface structures 40 suitable to attach the barrel 32 to the stock 34. For the embodiment shown, the barrel 32 has openings 40 that are aligned with openings 42, shown in FIGS. 4 and 5, on the stock 34. Once aligned, connectors (not shown), such as bolts, may be inserted into the openings 40, 42 to attach the barrel 32 to the stock 34. As various methods and apparatuses for attaching crossbow barrels to stocks are well known, additional details will not be provided here.

Figure 6:
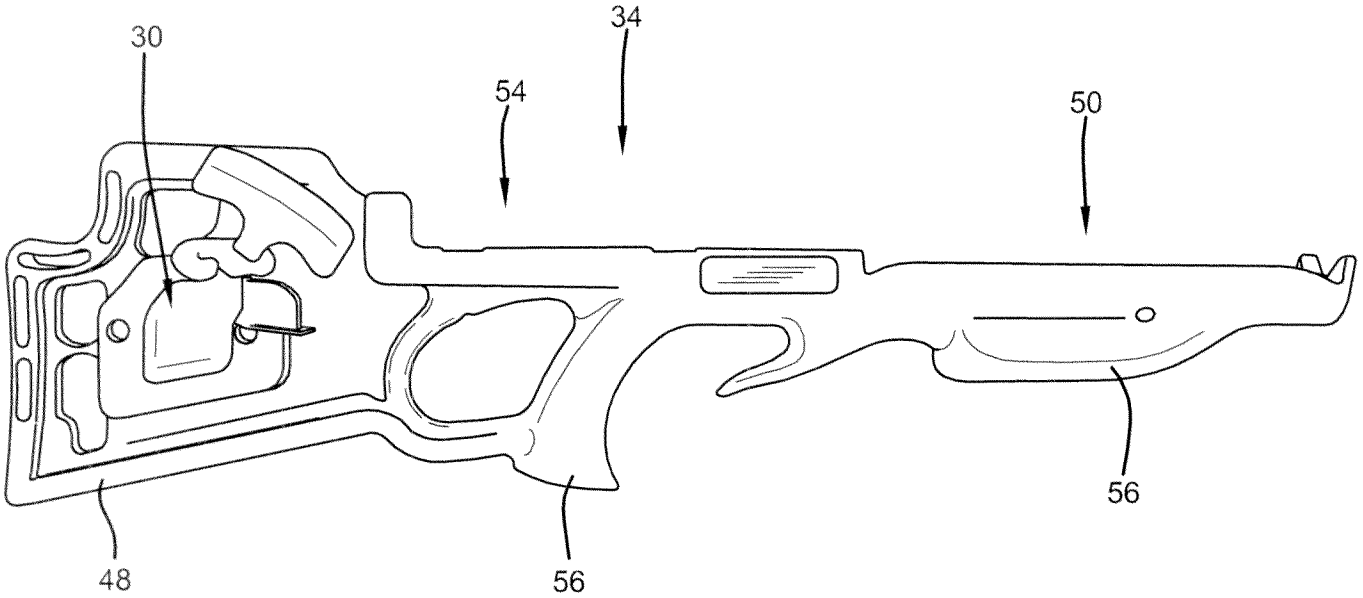
FIG. 6 is a side view of the stock shown in FIG. 4.
Figure 7:
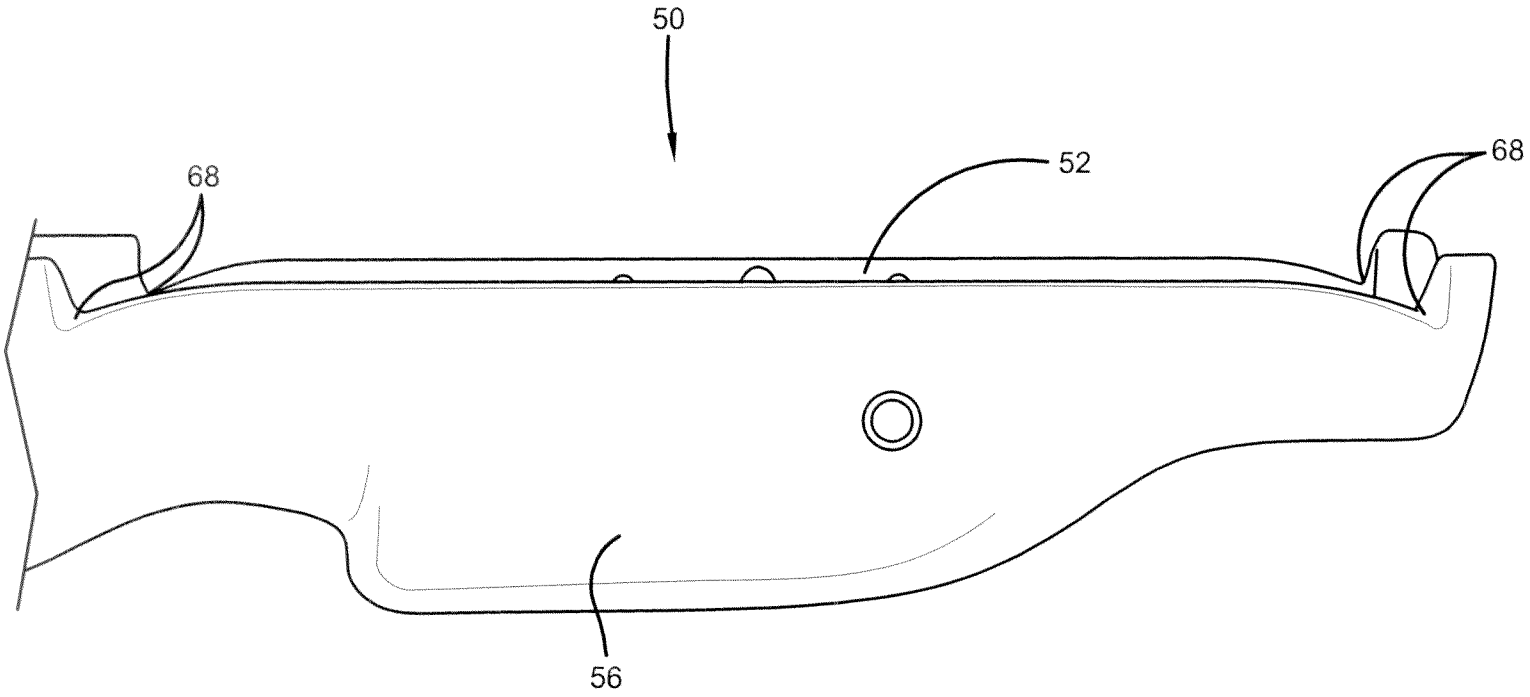
FIG. 7 is a close-up view of the distal end of the stock shown in FIG. 6.
Figure 8:
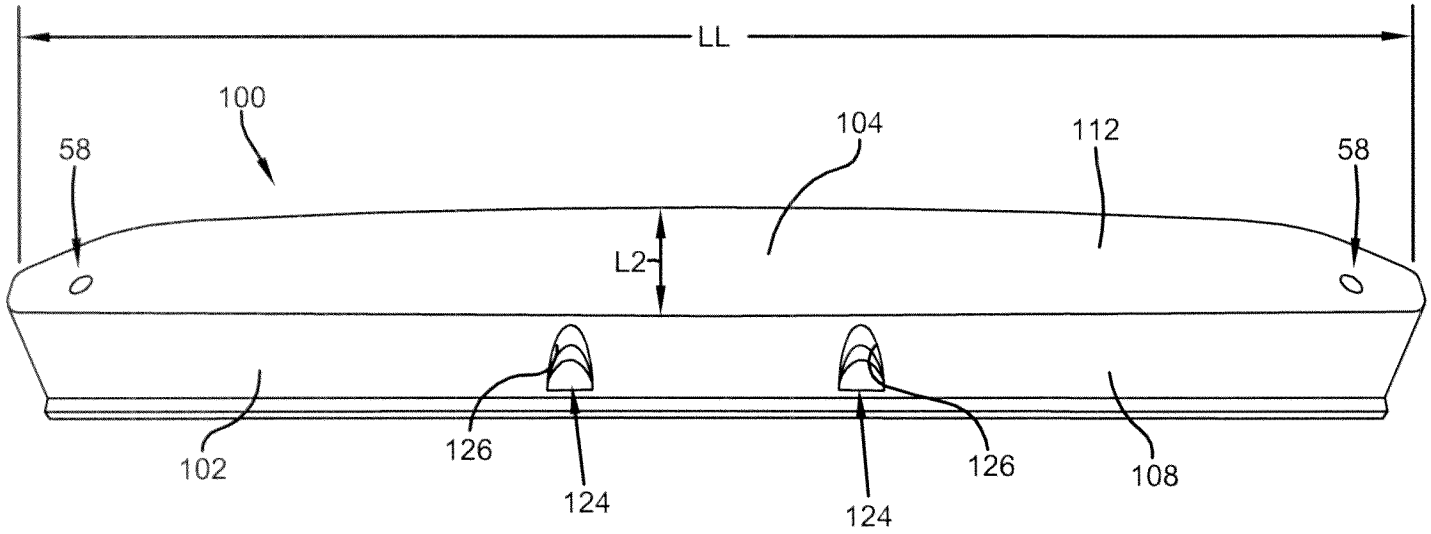
FIG. 8 is a top view of a grip guard according to some embodiments of this invention.
Figure 9:
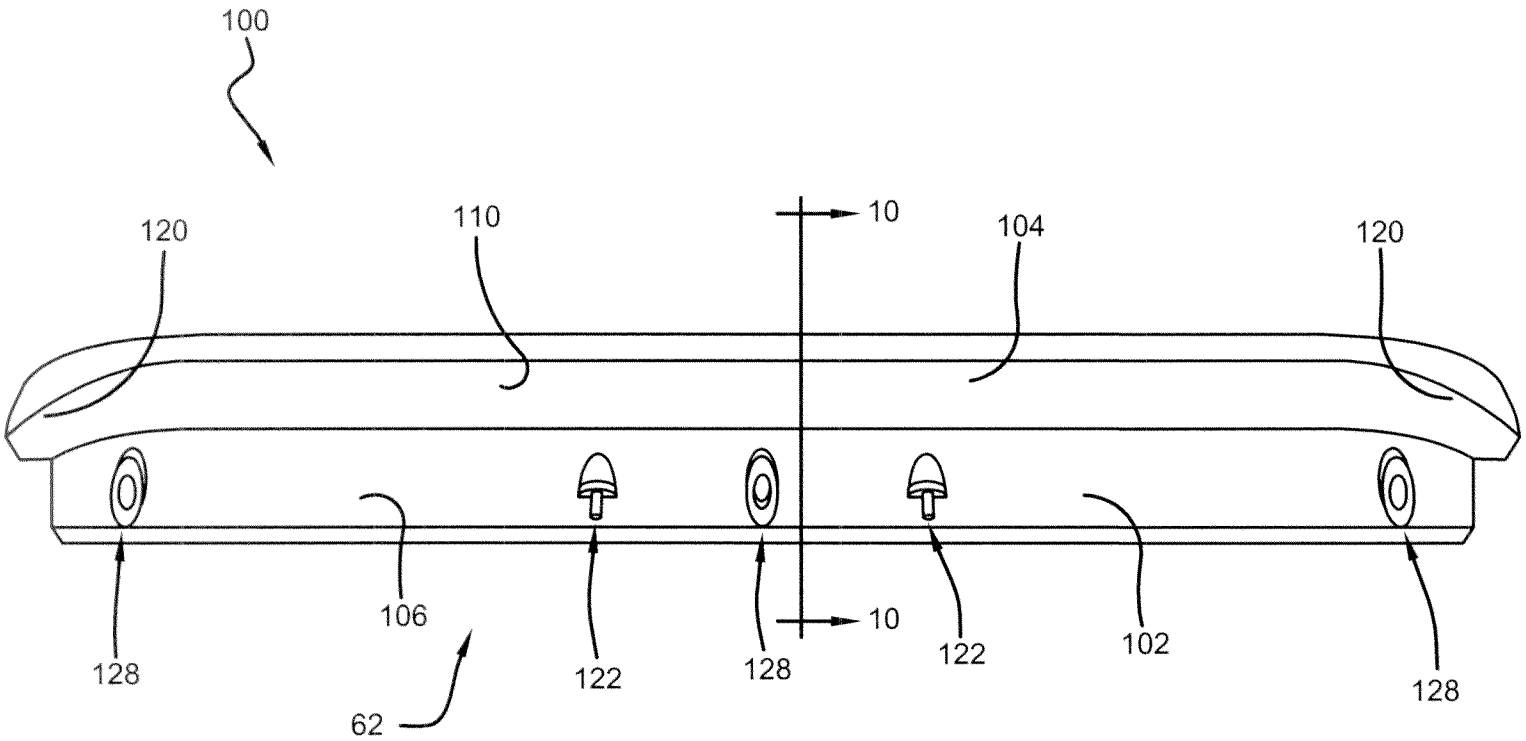
FIG. 9 is a bottom view of the grip guard shown in FIG. 8.

With reference now to FIGS. 1 and 6-7, the stock 34 may have a proximal end with a butt portion 48 that is normally positioned against the user's shoulder when the crossbow 10 is being aimed and/or fired. It should be noted, however, that this invention may be useful with crossbow stocks that don't have a butt portion, such as so called "pistol" crossbows. The stock 34 may have a distal end with a barrel receiving portion 50 that receives the barrel 32. For the embodiment shown, the barrel receiving portion 50 comprises a channel 52. Other components, such as a sight (not shown) may be supported to the stock 34 and/or barrel 32 such as at location 54. The stock 34 may have one or more handles 56 that are suitable to be gripped by the user to hold the crossbow 10 when transporting the crossbow 10 and/or when firing the crossbow 10. The proximal handle 56 may be used to support the user's "shooting" hand while the distal handle 56 may be used to support the user's "support" hand when firing the crossbow 10.

With reference now to FIGS. 1 and 8-11, at least one grip guard 100 may be positioned between the barrel 32 and the stock 34. For the embodiment shown, one grip guard 100 is positioned between the barrel 32 and the stock 34 on the first side 44 of the main beam 12 and another grip guard 100 is positioned between the barrel 32 and the stock 34 on the second side 46 of the main beam 12. In one embodiment, the grip guard used on the first side 44 of the main beam 12 is substantially identical in size and shape to the grip guard used on the second side 46. This has the advantage of reducing required parts when more than one grip guard is required. The grip guard 100 may have first and second walls 102, 104 each having first sides 106, 110 and second sides 108, 112. The first wall 102 may be positioned between the stock 34 and the barrel 32 with the first side 106 contacting the stock 34 and the second side 108 contacting the barrel 32. With this arrangement, the second wall 104 extends outwardly from the main beam 12 and is positioned at least partially between the handle 56 and the barrel 31. Thus, when the user's hand 60 is properly holding the handle 56 to fire the crossbow 10, such as is shown in FIG. 12, the second wall 104 forms a barrier preventing the user's fingers from extending beyond the second wall 104 toward the barrel 32. When two grip guards 100, 100 are used, the same arrangement may be used on each side 44, 46 of the main beam 12.

Figure 13:
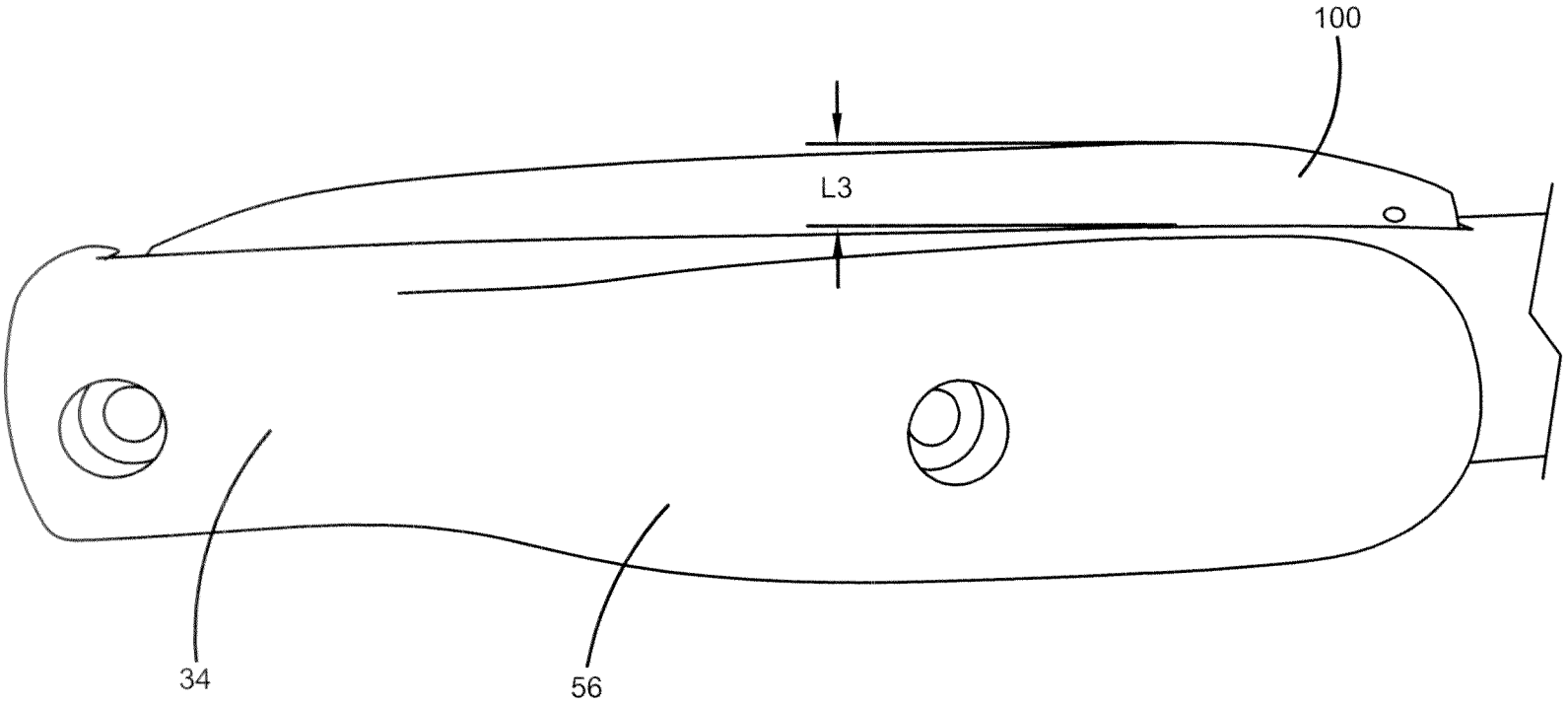
FIG. 13 is a bottom view of the stock and grip guard shown in FIG. 18.

With reference now to FIGS. 8-11, the grip guard 100 may have a longitudinal length LL and the first and second walls 102, 104 may have lateral lengths L1 and L2, as shown. The walls 102, 104 may be generally planar, as shown, and may have widths W1, W2. While these dimensions can be any chosen with the sound judgment of a person of skill in the art, for the embodiment shown length L1 is between 0.4 inches and 0.8 inches, length L2 is between 0.7 inches and 1.1 inches, width W1 is between 0.1 inches and 0.2 inches, and width W2 is between 0.1 inches and 0.3 inches. These dimensions combine to create lateral length L3, shown in FIG. 13, which the grip guard 100 extends outwardly from the main beam 12. Length W3 may be between 0.5 inches to 0.8 inches although it could greater than 0.8 inches if desired. Length L2, for the embodiment shown, is not consistent throughout length LL as the opposite ends of the grip guard 100 may be curved inwardly as shown at locations 58 in FIG. 8.

Figure 10:
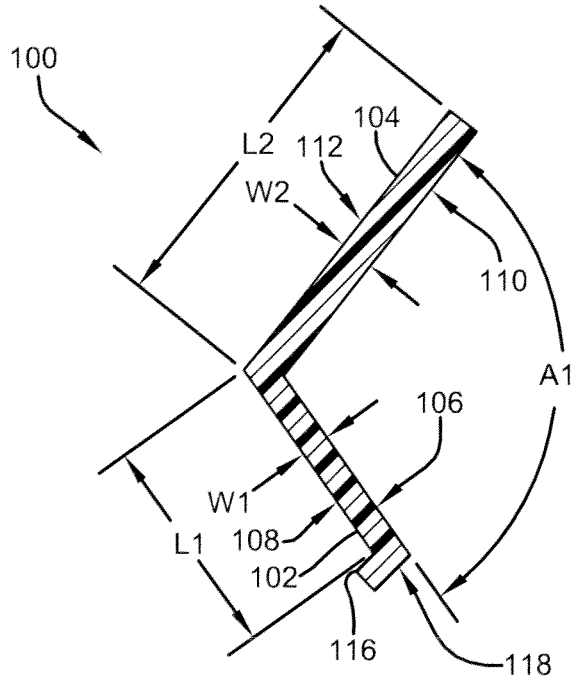
FIG. 10 is a sectional view of the grip guard along line 10-10 of FIG. 9.
Figure 11:
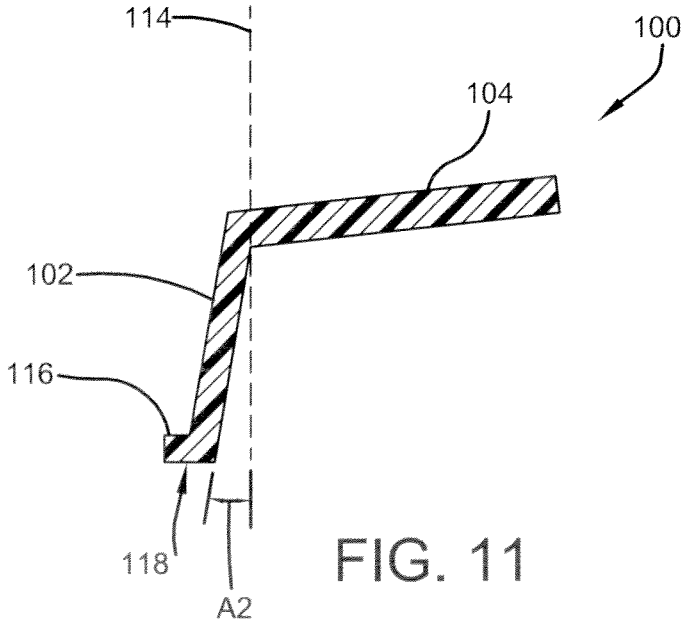
FIG. 11 is a view of the grip guard shown in FIG. 10 except rotated.
Figure 12:
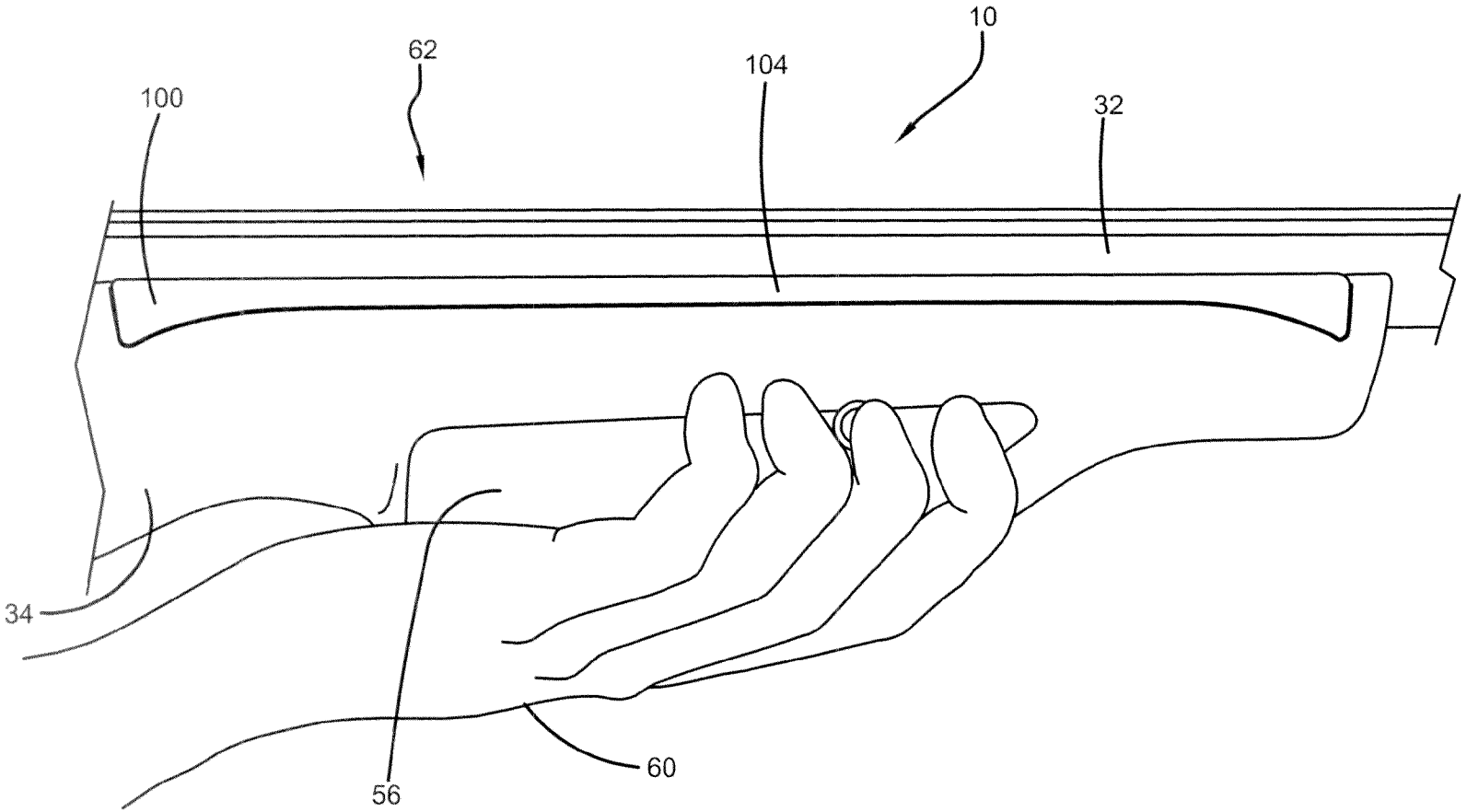
FIG. 12 is a side view of a portion of the crossbow shown in FIG. 1 except showing a user's hand holding the crossbow.

With continuing reference to FIGS. 8-11, the walls 102, 104 may form a V-shape separated by angle A1 as shown in FIG. 10. In one embodiment, angle A1 is between 45 degrees and 170 degrees. In another embodiment, angle A1 is between 75 degrees and 160 degrees. In yet another embodiment, angle A1 is between 90 degrees and 150 degrees. For the specific embodiment shown, A1 is approximately 135 degrees. In one embodiment, the second wall 104 that forms the barrier may extend substantially horizontally from the main beam 12 (this assumes that the user will hold the crossbow 10 is a substantially level or parallel to the ground orientation) as shown in FIG. 11. In this case, the second wall 104 is substantially perpendicular to a vertical line 114 that is perpendicular to a ground surface. For the embodiment shown, the first wall 102 is angled at an acute angle A2 with respect to the vertical line 114. In one embodiment, angle A2 is between 5 degrees and 85 degrees. In another embodiment, angle A2 is between 5 degrees and 45 degrees. In another embodiment, angle A2 is between 30 degrees and 10 degrees. For the embodiment shown, angle A2 is approximately 20 degrees. A lip 116 may extend from the outer end of the first wall 102. In one embodiment, shown, the lip 116 is arranged to be substantially parallel with the second wall 104. A distal end of the first wall 102 may define a contact surface 118. If a lip 116 is used, the size of the contact surface 118 may be increased, as shown.

With reference now to FIGS. 1-3, 6 and 8-12, the first wall 102 of the grip guard 100 may provide dampening properties for the crossbow 10 to attenuate sounds and vibrations caused by firing the crossbow 10. The dampening properties may be achieved in any manner chosen with the sound judgment of a person of skill in the art. In one embodiment, the dampening properties are achieved based on the material used to make the first wall 102. The first wall 102 may, for some non-limiting examples, be formed of a pliable compound such as flexible polyurethane and/or a rubber. In one embodiment, the first wall 102 is formed of a different material than the second wall 104. In another embodiment, the first and second walls 102, 104 are made of the same material. The first and second walls 102, 104 may be made separately and then attached together or may be made together, such as via a molding operation. It is common for stocks 34 and barrels 32 to be made of different materials. Barrels, for instance, may be formed of a metal, typically aluminum or an aluminum alloy. Stocks, for instance, may be formed of wood or aplastic. In one embodiment, the first wall 102 of the grip guard 100 is made of a different material than either the stock 34 or the barrel 32. In this case, the first wall 102 may be made of a material that is different that the material used to make the surface of the stock 34 that contacts the first side 106 of the first wall 108 of the grip guard 100 and different than the material used to make the surface of the barrel 32 that contacts the second side 108 of the first wall 102. These different materials may enhance the damping characteristics for the grip guard 100.

With reference now to FIGS. 1-3, 6-11, and 14-16, as noted above, the barrel receiving portion 50 may comprises a channel 52. This channel 52 may be formed, at least in part, by a pair of side walls 64, 64 on opposite sides of the main beam 12, as shown. While the side walls 64, 64 may have any orientation chosen with the sound judgment of a person of skill in the art, the side walls 64, 64 shown angle inwardly from top to bottom. Such inward angling or slanting creates a V-shape for the barrel receiving portion 50 that makes it easy to insert and center or align the barrel 32 with respect to the stock 34. In one embodiment, the angle of the side walls 64, 64 matches the angle A2 of the grip guard 100. In this case, when the first side 106 of the first wall 102 is positioned onto a side wall 64, the second wall 104 will extend outwardly substantially perpendicular to the ground, as shown in FIG. 11. At the lower end of the side walls 64, 64, the stock 34 may comprise a shelf 66, 66 as seen best in FIGS. 14-16. The contact surface 118 of the first wall 102, shown in FIGS. 10-11, may contact the shelf 66, providing another support surface to support the grip guard 100 to the stock 34.

Figure 14:
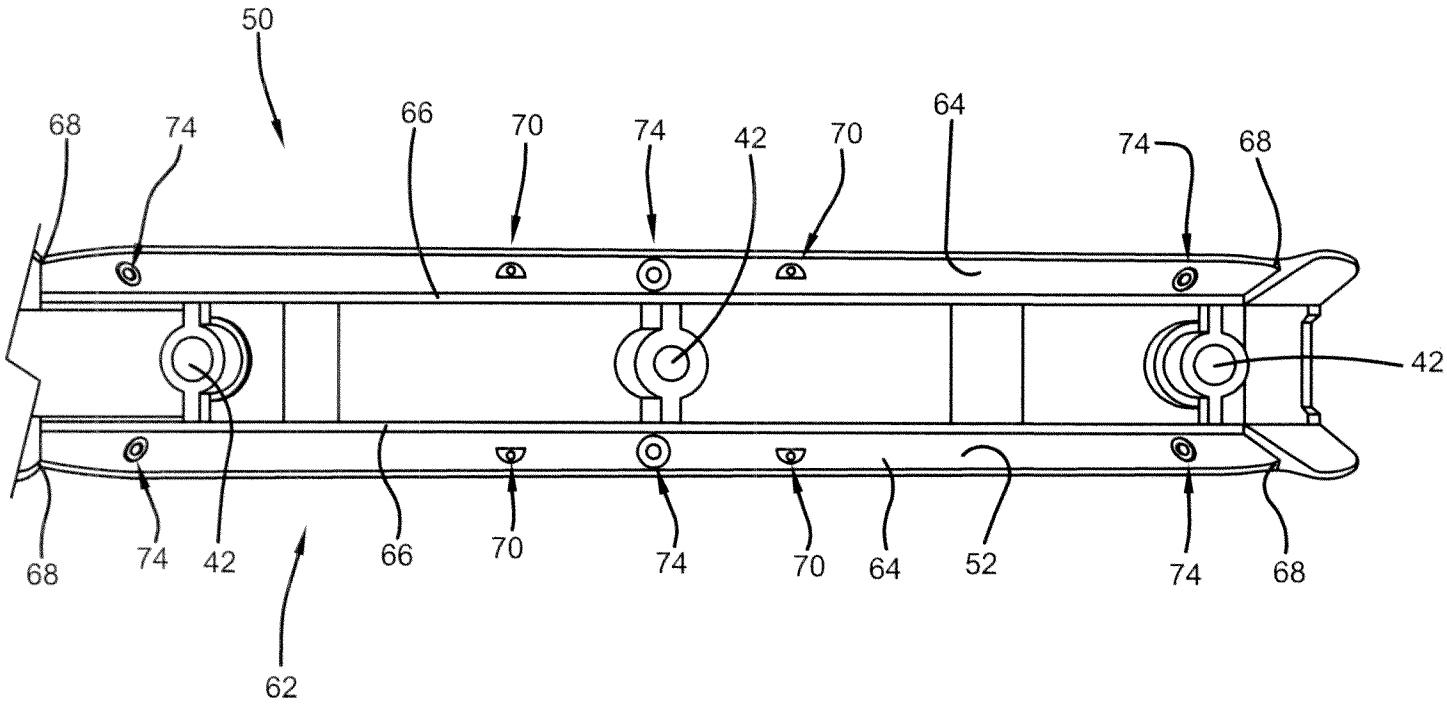
FIG. 14 is a close-up view of the distal end of the stock shown in FIG. 4.
Figure 15:
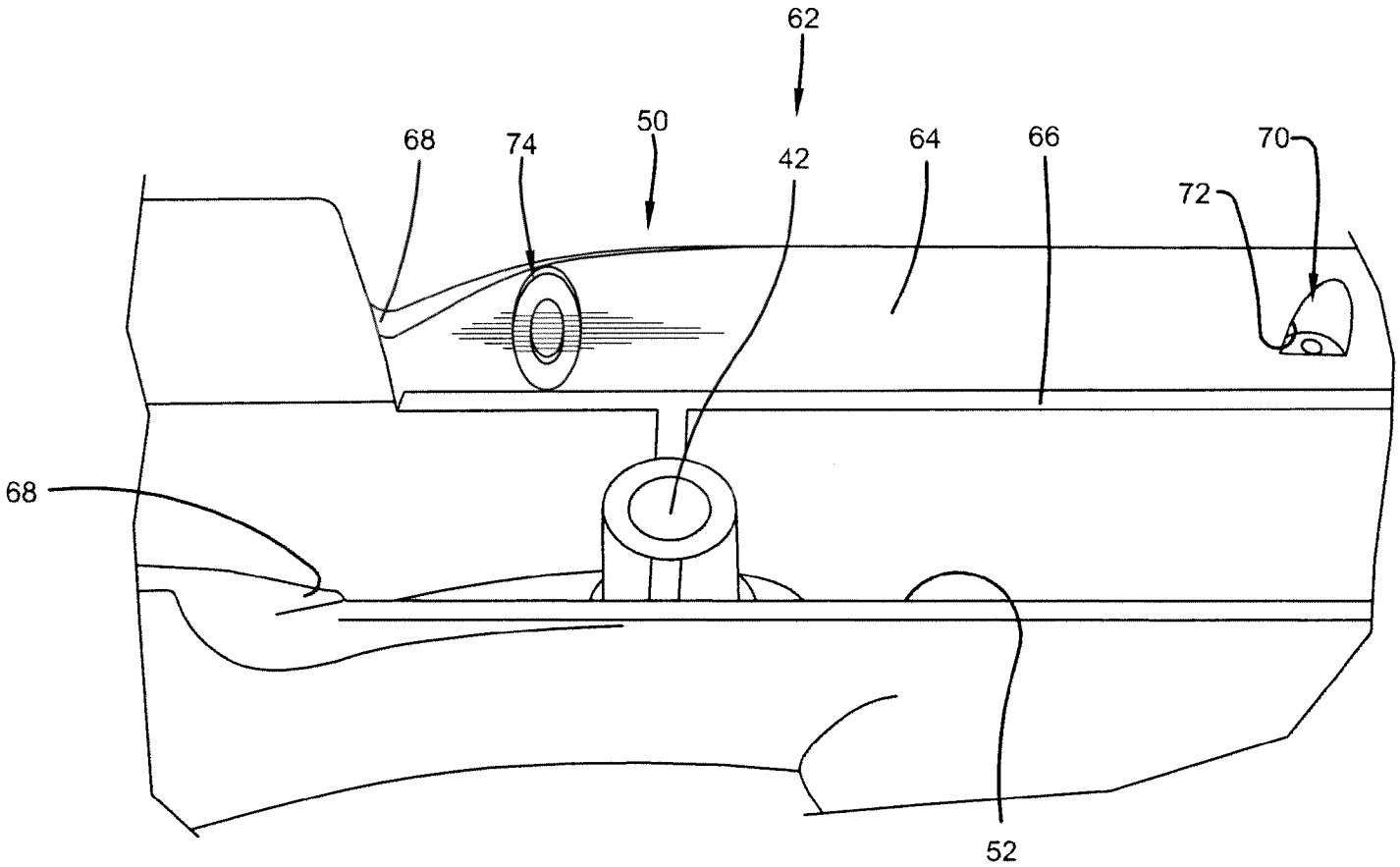
FIG. 15 is a perspective top view of the proximal end portion of the stock shown in FIG. 14.
Figure 16:
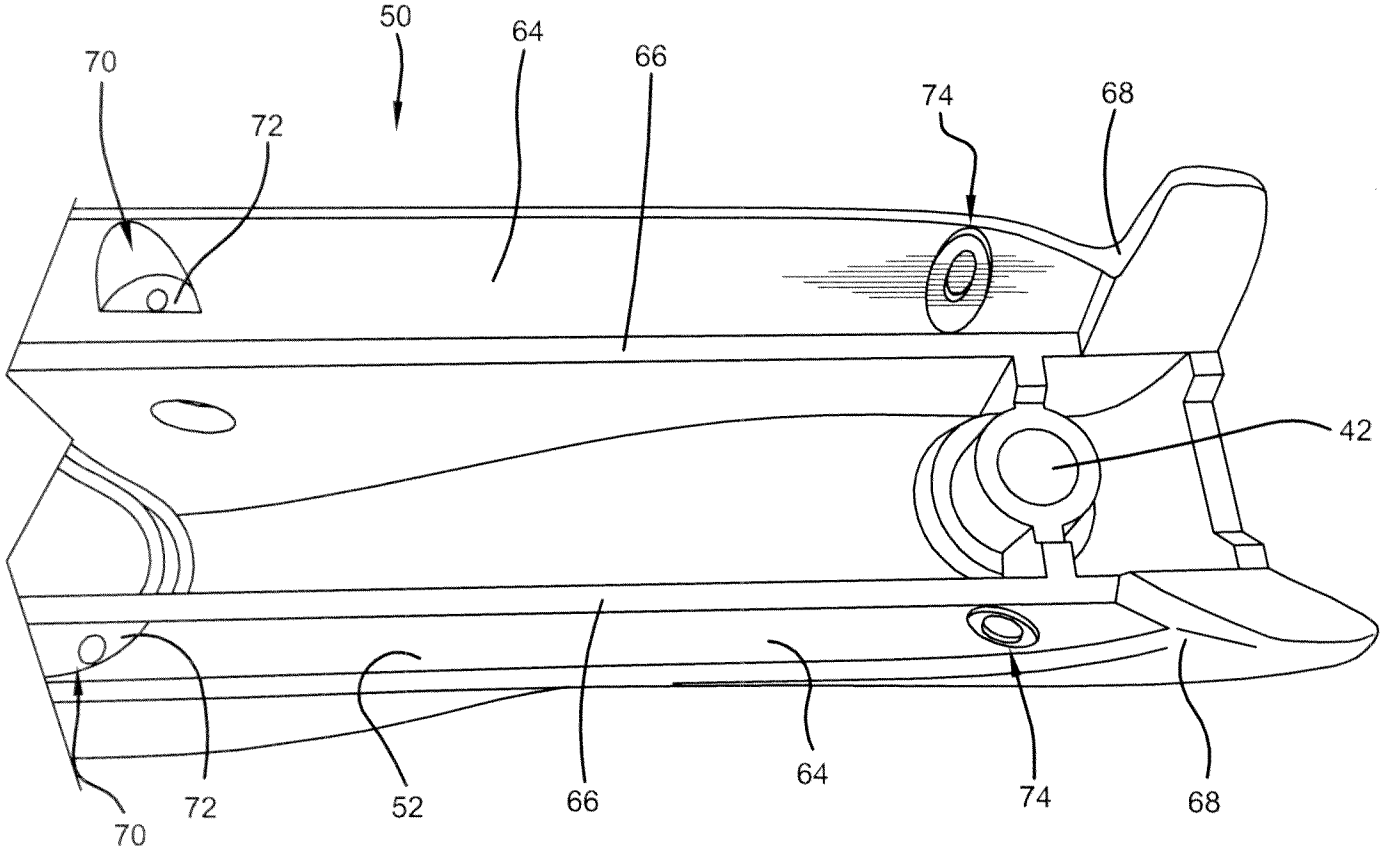
FIG. 16 is a perspective top view of the distal end portion of the stock shown in FIG. 14.
Figure 17:
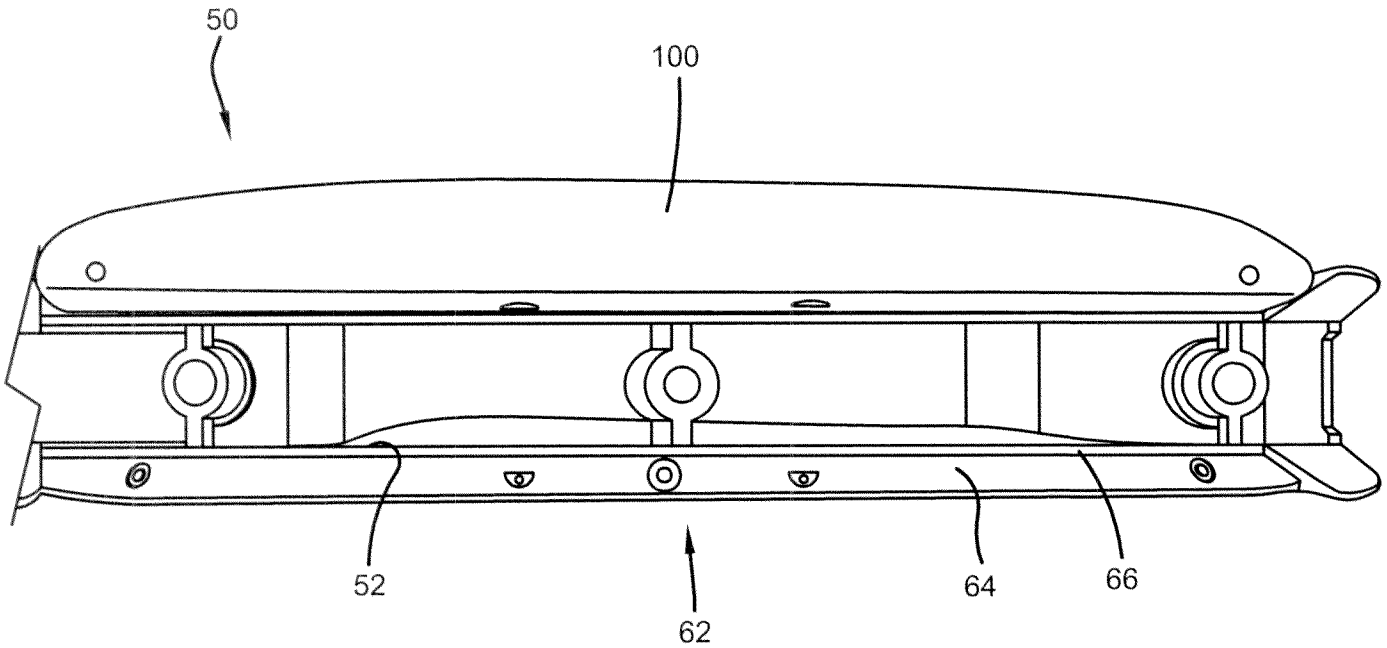
FIG. 17 is a view similar to that shown in FIG. 14 but showing a grip guard attached to one side of the stock.

With reference now to FIGS. 1 and 12, in one embodiment, the grip guard(s) 100 are held in place solely by the force of the barrel 32 against the grip guard(s) 100 and stock 34 and, if used, the contact surface 118 of the grip guard(s) 100, as shown in FIGS. 10-11, on the shelf 66, shown in FIGS. 14-16. In another embodiment, attachment means may be used to attach each grip guard 100 to the barrel 32. In yet another embodiment, shown, attachment means 62 may be used to attach each grip guard 100 to the stock 34. With this arrangement, once the grip guard(s) 100 is attached to the stock 34, it is only necessary to insert the barrel 32 into the barrel receiving portion 34 of the stock 34 and onto the first wall 102 of the grip guard 100. The barrel 32 may then be attached to the stock 34, as discussed above, to "sandwich" the first wall 102 of the grip guard(s) 100 between the stock 34 and the barrel 32.

Figure 18:
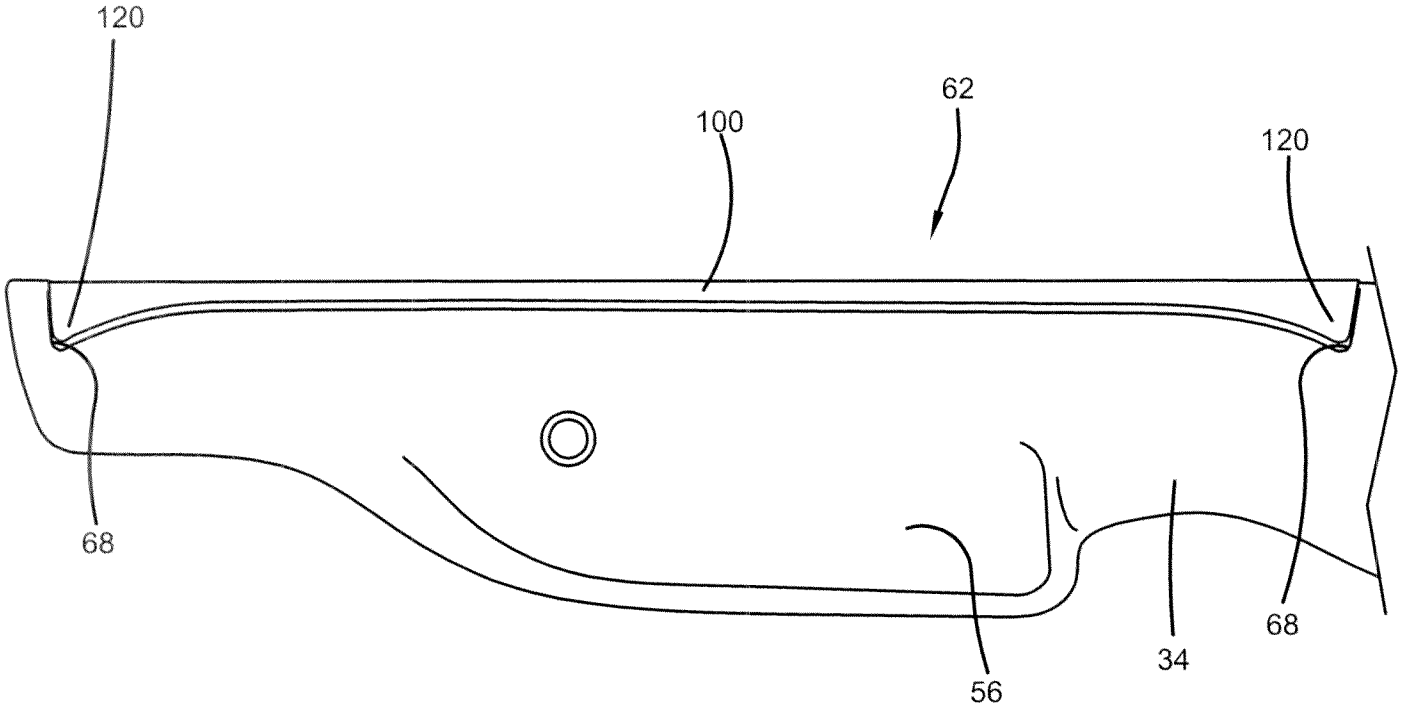
FIG. 18 is a side view of the stock and grip guard shown in FIG. 17.
Figure 19:
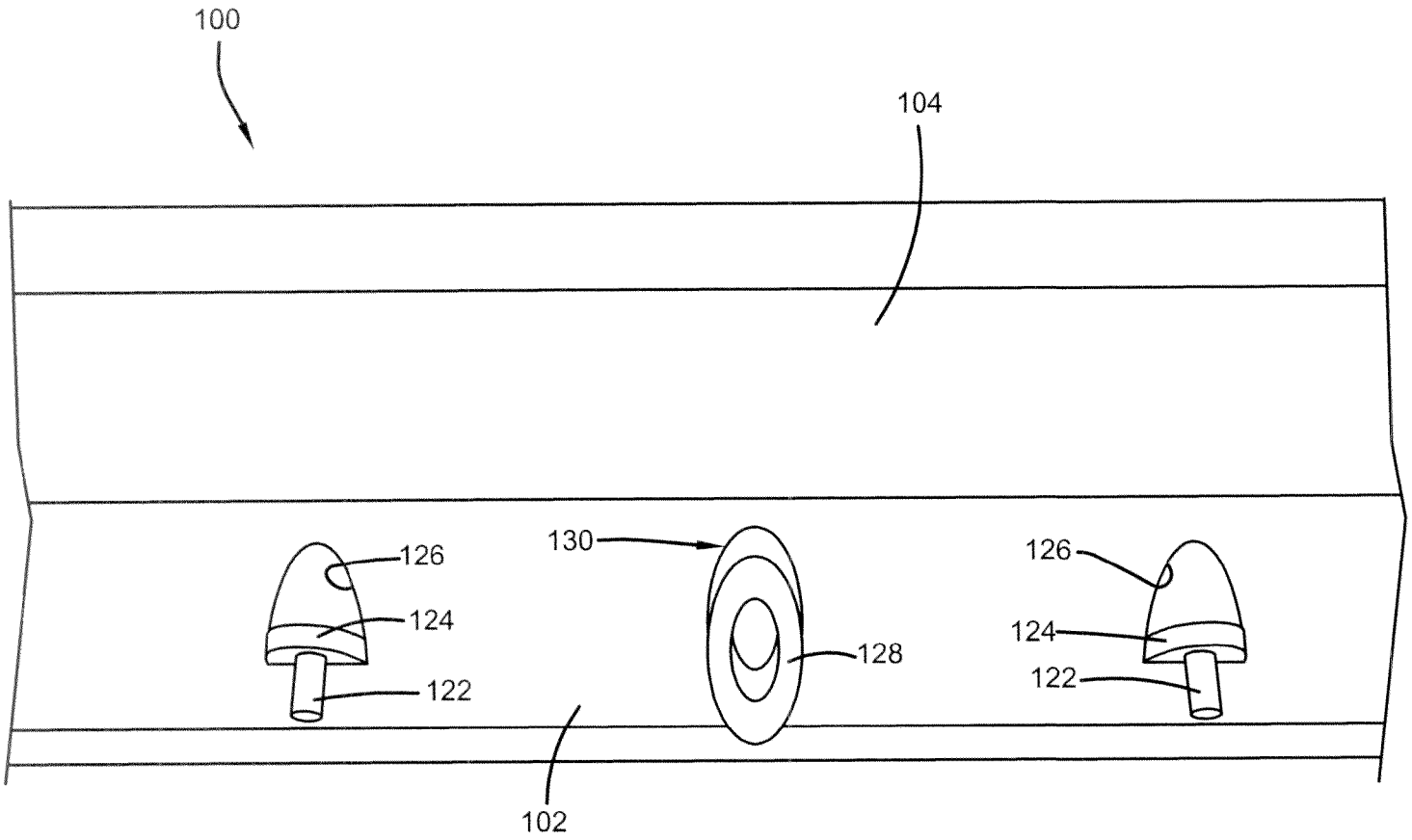
FIG. 19 is a close-up view of a portion of the grip guard shown in FIG. 9.

With reference now to FIGS. 1, 9, 12 and 14-19, the attachment means 62 may comprise at least one convex surface formed on one of the stock 34 and the grip guard 100 and at least one concave surface formed on the other of the stock 34 and the grip guard 100. The convex surface may be received in the concave surface to attach the grip guard 100 to the stock 34. While the number, size, type and location of such convex and concave surfaces can be any chosen with sound judgement of a person of skill in the art, embodiments that have been found to be effective will now be described. In one embodiment, two concave surfaces in the form of grooves 68, 68 are formed in the side wall 64 and convex surfaces in the form of tabs 120, 120 are formed on opposite ends of the second wall 104 of the grip guard 100. The tabs 120, 120 may then be received in the grooves 68, 68 as shown in FIG. 18. Alternatively, the tabs could be formed in the stock 34 and the grooves could be formed in the grip guard 100. In another embodiment, at least one concave surface (two shown) in the form of a hole 70 is formed in the side wall 64 and at least one convex surface (two shown) in the form of a pin 122 is formed on the second wall 104 of the grip guard 100. Each pin 12 may then be received in a hole 70. Alternatively, the pin could be formed in the stock 34 and the hole could be formed in the grip guard 100. To keep the pin and hole oriented substantially vertically, the side wall 64 may have a platform 72 that extends substantially horizontally (when the crossbow 10 is held in a level orientation) into which the hole 70 is formed and the first wall 102 may have a platform 124 that extends substantially horizontally (when the crossbow 10 is held in a level orientation) from which the pin 122 extends. So that the platform 124 may be seen when attaching the grip guard 100 to the stock 34, a hollow 126 may be formed above the platform 124. In one embodiment, shown, the hollow 126 includes an opening formed through the first wall 102 just above the platform 124. In another embodiment, at least one concave surface (three shown) in the form of an O or doughnut shape 74 is formed in the side wall 64 and at least one convex surface (three shown) in the form of an O or doughnut shape 128 is formed on the second wall 104 of the grip guard 100. The doughnut shaped concave surfaces 74 may have a center portion that extends relatively outwardly and an outer portion that extends relatively inwardly. The doughnut shaped convex surfaces 128 may have a center portion that extends relatively inwardly and an outer portion that extends relatively outwardly. Each convex surface 128 may then be received in a concave surface 74. Alternatively, the convex surface(s) could be formed in the stock 34 and the concave surface(s) could be formed in the grip guard 100. To provide easy attachment of the doughnut shape(s) 128 to the doughnut shape(s) 74, the convex surface 128 may be slanted downwardly—as shown at location 130 in FIG. 19. The doughnut shape(s) 74, in this embodiment, has a matching concave surface. For the specific embodiment shown in FIG. 9, the first wall 102 has convex surfaces 128, 128 at opposite ends and a third 128 in a mid-section between the pins 122, 122. The side walls 64, 64 have matching surfaces as shown in FIG. 14.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right claim elements and/or sub-combinations that are disclosed herein as other inventions in other patent documents is hereby unconditionally reserved.

We claim:

1. A crossbow, comprising:

(A) a main beam having first and second sides and comprising:
  (1) a stock that comprises a handle that is suitable to be gripped by an associated user to hold the crossbow when firing the crossbow;
  (2) a barrel that: (a) is suitable to support an associated projectile for firing by the crossbow; and, (b) is supported to the stock;

(B) first and second limbs that:
  (1) are supported to the main beam; and,
  (2) extend outwardly from proximal ends to distal ends on opposite sides of the main beam;

(C) a bowstring that:
  (1) is strung between the distal ends of the first and second limbs; and,
  (2) is adjustable from an uncocked position to a cocked position;

(D) a trigger mechanism that:
  (1) is supported to the main beam;
  (2) is operable to hold the bowstring in the cocked position; and,
  (3) is operable to release the bowstring to fire the associated projectile;

(E) a first grip guard comprising:
  (1) a first wall that: (a) is positioned between the stock and the barrel on the first side of the main beam; (b) has a first side that contacts the stock on the first side of the main beam; and, (c) has a second side opposite the first side that contacts the barrel on the first side of the main beam; and, (2) a second wall that: (a) extends outwardly from the first side of the main beam; (b) is positioned at least partially between the handle and the barrel on the first side of the main beam; and, (c) when the associated user's hand having fingers is properly holding the handle to fire the crossbow, prevents the fingers from extending beyond the second wall of the first grip guard toward the barrel on the first side of the main beam; and, (F) a second grip guard comprising:

(1) a first wall that: (a) is positioned between the stock and the barrel on the second side of the main beam; (b) has a first side that contacts the stock on the second side of the main beam; and, (c) has a second side opposite the first side that contacts the barrel on the second side of the main beam; and, (2) a second wall that: (a) extends outwardly from the second side of the main beam; (b) is positioned at least partially between the handle and the barrel on the second side of the main beam; and, (c) when the associated user's hand is properly holding the handle to fire the crossbow, prevents the fingers from extending beyond the second wall of the second grip guard toward the barrel on the second side of the main beam.

2. The crossbow of claim 1 wherein:

the first wall of the first grip guard provides dampening properties for the crossbow to attenuate sounds and vibrations caused by firing the crossbow; and, the first wall of the second grip guard provides dampening properties for the crossbow to attenuate the sounds and vibrations caused by firing the crossbow.

3. The crossbow of claim 2 wherein the first and second grip guards are substantially identical in size and shape.

4. The crossbow of claim 2 wherein:

interior surfaces of the stock that contact the first sides of the first walls of the first and second grip guards are made of a first material;

surfaces of the barrel that contact the second sides of the first walls of the first and second grip guards are made of a second material;

the first walls of the first and second grip guards are made of a third material that is significantly different than the first and second materials.

5. The crossbow of claim 1 wherein:

the stock comprises first and second side walls and first and second shelves at a lower end of the first and second side walls, respectively;

the first walls of the first and second grip guards comprise first and second contact surfaces, respectively, at distal ends of the first walls; and, the first and second grip guards are supported to the stock by contacting the first and second contact surfaces to the first and second shelves.

6. The crossbow of claim 1 wherein:

the stock comprises first and second side walls that are angled inwardly from top to bottom;

the first walls of the first and second grip guards are angled at an angle A2 that is between 5 degrees and 45 degrees with respect to a vertical line;

the first walls of the first and second grip guards are positioned onto the first and second interior side walls, respectively; and, the angle A2 matches the angle that the first and second side walls are angled so that the second walls extend outwardly substantially perpendicular to the ground when the crossbow is held in a level position.

7. The crossbow of claim 1 wherein:

a first interior surface of the stock contacts the first side of the first wall of the first grip guard;

a second interior surface of the stock contacts the first side of the first wall of the second grip guard;

one of the first interior surface of the stock and the first side of the first wall of the first grip guard has a convex surface;

the other of the first interior surface of the stock and the first side of the first wall of the first grip guard has a concave surface;

the other of the first interior surface of the stock and the first side of the first wall of the first grip guard has a concave surface;

one of the second interior surface of the stock and first side of the first wall of the second grip guard has a convex surface;

the other of the second interior surface of the stock and the first side of the wall of the second grip guard has a concave surface;

the first and second grip guards are attached to the first and second sides of the stock, respectively, by receiving the convex surfaces in the corresponding concave surfaces.

8. A grip guard for use with an associated crossbow wherein:

the associated crossbow comprises:

(A) a main beam comprising:

(1) a stock that comprises a handle that is suitable to be gripped by an associated user to hold the crossbow when firing the crossbow; and an interior surface;

(2) a barrel that: (a) is suitable to support an associated projectile for firing by the crossbow; and, (b) is supported to the stock;

(B) first and second limbs that:

(1) are supported to the main beam; and, (2) extend outwardly from proximal ends to distal ends on opposite sides of the main beam;

(C) a bowstring that:

(1) is strung between the distal ends of the first and second limbs; and, (2) is adjustable from an uncocked position to a cocked position; and, (D) a trigger mechanism that:

(1) is supported to the main beam;

(2) is operable to hold the bowstring in the cocked position; and, (3) is operable to release the bowstring to fire the associated projectile; and, the grip guard comprises:

(A) a first wall that: (1) is sandwiched between the interior surface of the stock and the barrel; (2) has a first side that contacts the interior surface of the stock; and, (3) has a second side opposite the first side that contacts the barrel; and, (B) a second wall that: (1) extends outwardly from the main beam; (2) is positioned at least partially between the handle and the barrel; and, (3) when the associated user's hand having fingers is properly holding the handle to fire the crossbow, prevents the fingers from extending beyond the second wall toward the barrel.

9. The grip guard of claim 8 wherein:

the first wall is generally planar;

the second wall is generally planar; and, the first and second walls form a V-shape separated by an angle A1 that is between 45 degrees and 170 degrees.

10. The grip guard of claim 9 wherein:

the angle A1 is between 75 degrees and 160 degrees.

11. The grip guard of claim 8 wherein:

one of the interior surface of the associated stock and the first side of the first wall of the grip guard has a convex surface;

the other of the interior surface of the associated stock and the first side of the first wall of the grip guard has a concave surface; and, the convex surface is received in the concave surface to attach the grip guard to the associated stock.

12. The grip guard of claim 8 wherein:

the first wall of the grip guard provides dampening properties for the crossbow to attenuate sounds and vibrations caused by firing the associated crossbow.

13. The crossbow of claim 8 wherein for of the first and second grip guards:

the first wall is generally planar;

the second wall is generally planar; and, the first and second walls form a V-shape separated by an angle A1 that is between 45 degrees and 170 degrees.

14. The crossbow of claim 13 wherein for each of the first and second grip guards:

the angle A1 is between 75 degrees and 160 degrees.

15. The grip guard of claim 8 wherein:

the interior surface of the stock is angled inwardly from top to bottom;

the first wall of the grip guard is angled at an angle A2 that is between 5 degrees and 45 degrees with respect to a vertical line; and, the angle A2 matches the angle that the interior surface of the stock is angled so that the second wall extends outwardly substantially perpendicular to the ground when the crossbow is held in a level position.

* * * * *